United States Patent [19]

Rendon et al.

[11] Patent Number: 4,881,840

[45] Date of Patent: Nov. 21, 1989

[54] PRINTER HAVING PAPER-OUT AND COLUMN ZERO DETECTION MECHANISM

[75] Inventors: Mark A. Rendon, Belton; Erik A. Treszoks; Thomas R. Grimm, both of Temple, all of Tex.

[73] Assignee: Texas Instruments Incorporated, Dallas, Tex.

[21] Appl. No.: 251,435

[22] Filed: Sep. 30, 1988

[51] Int. Cl.[4] ..... B41J 29/42; B41J 29/38

[52] U.S. Cl. ..... 400/705.1; 400/708; 400/711

[58] Field of Search ..... 400/705, 705.1, 705.3, 400/662, 706, 707.1, 708, 711, 716

[56] References Cited

U.S. PATENT DOCUMENTS

| | | | |
|---|---|---|---|
| 2,293,283 | 8/1942 | Dow | 400/708 |
| 2,320,110 | 5/1943 | Walker | 400/705.3 |
| 4,540,299 | 9/1985 | Yamada | 400/639.1 X |
| 4,690,577 | 9/1987 | Kikuchi | 400/708 |
| 4,800,402 | 1/1989 | Lake | 400/708 X |

FOREIGN PATENT DOCUMENTS

| | | | |
|---|---|---|---|
| 87983 | 6/1982 | Japan | 400/705.1 |

*Primary Examiner*—Paul T. Sewell

*Attorney, Agent, or Firm*—James T. Comfort; N. Rhys Merrett; Melvin Sharp

[57] ABSTRACT

A printer has a detection mechanism for detecting the absence of paper and the end position of the printhead upon start-up and reset. The detection mechanism includes a detection lever arm that is spring loaded and operationally positioned in a normal state. An optical sensor made up of an LED and a photo transistor that receives light from the LED, has the lower end of the detection lever arm operationally positioned in the normal state, between the LED and the photo transistor. The upper end of the detection lever arm is urged against the paper, by the spring. The platen supporting the paper has a groove formed therein which, in the absence of paper, receives the upper end of the detection lever arm, causing the lower end to move from its normal position between the LED and the photo transistor, the optical sensor then indicating a paper-out condition. The carriage for supporting and moving the printhead has an activation arm that moves against the detection lever arm when the carriage moves to the leftmost position, thereby moving the lower end of the lever arm away from the normal state, the optical sensor then indicating a column one position.

19 Claims, 5 Drawing Sheets

PRINTER HAVING PAPER-OUT AND COLUMN ZERO DETECTION MECHANISM

BACKGROUND OF THE INVENTION

1. Field of the Invention

This invention relates to printers, and more particularly to printers having a mechanism for detecting a paper-out condition and a column one position.

2. Description of the Prior Art

In the past, paper-out detection has been done using a limit switch. These switches are very sensitive to changes in paper thickness and are difficult to adjust.

Optical devices have also been used to detect a paper-out condition. These optical devices ordinarily are equipped with a light emitting diode (LED) to shine on the paper and a photo transistor to receive the light reflected from the paper. These optical devices are very sensitive to ambient light levels and therefore must be shielded from any outside light source, but still must be open to the extent that the light is permitted to shine on the paper and reflect back. They are also susceptible to debris dropping from the paper or from the printer mechanism, which debris may obscure the light path.

In the prior art, end position of the carriage has been detected by simple electromechanical switches which are very sensitive and difficult to adjust. They also tend to be rather short lived. Optical reflection devices as mentioned above have also been used for detecting the end position of the carriage. Also, a pad associated with the carriage or the head has been used to interrupt a light beam between an LED and a photo transistor.

In the present invention, a lever attached to the carriage contacts the detection lever arm, moving it from its normal state and causing the LED to transmit light to the photo transistor.

There is no known mechanism in the prior art which employs essentially the same components for both the paper-out condition and column zero position detection. This invention also eliminates the sensitivity to debris, adjustment and paper thickness, transferring a gross mechanical movement to a very precise optical beam. Ambient light has no appreciable effect on this optical sensor.

BRIEF SUMMARY OF THE INVENTION

A printer for printing characters on paper (roll, fan fold and single sheet) employs a mechanism to detect a paper-out condition and column zero position. This mechanism uses a detection lever arm which is spring loaded and passes through a high resolution optical sensor. The optical sensor includes an LED that emits light to a photo transistor. In the normal operating position, the detection lever arm blocks the sensor beam.

The printer platen, which supports the paper, has a groove formed therein. The groove is dimensioned to receive the upper end of the detection lever arm when there is no paper covering the platen and the groove. The upper end moves into the groove due to the force exerted by the spring. The lower end of the detection lever arm, which in its normal position, blocks the sensor beam, moves out and the optical transistor receives light from the LED, providing a signal indicating that there is a paper-out condition.

The printhead (ink jet in this preferred embodiment) is mounted on a carriage which traverses the width of the paper for printing in one or both directions. An activation arm is attached to the carriage so that when the carriage is moved to the extreme left position, the activation arm engages the detection lever arm, pushing the lower end out of its normal position so that the optical transistor receives light from the LED, providing a signal indicative of the column zero position.

The principal object of this invention is to provide a printer having a mechanism for detecting both a paper-out condition and a column zero position.

Another object of this invention is to provide an optical sensor for a paper-out detector that relies on direct communication between an LED and a photo transistor without need for reflection.

Still another object of this invention is to provide a printer with a detection mechanism for a paper-out condition and a column zero position that is not sensitive to debris, adjustment and paper thickness.

These and other objects of this invention will be made evident in the detailed description that follows:

DETAILED DESCRIPTION OF THE INVENTION

The printer of this invention has a common mechanism for detecting both paper-out condition and a column zero position in a novel manner. For an understanding of the mechanism, turn first to FIG. 1.

Figure 1:
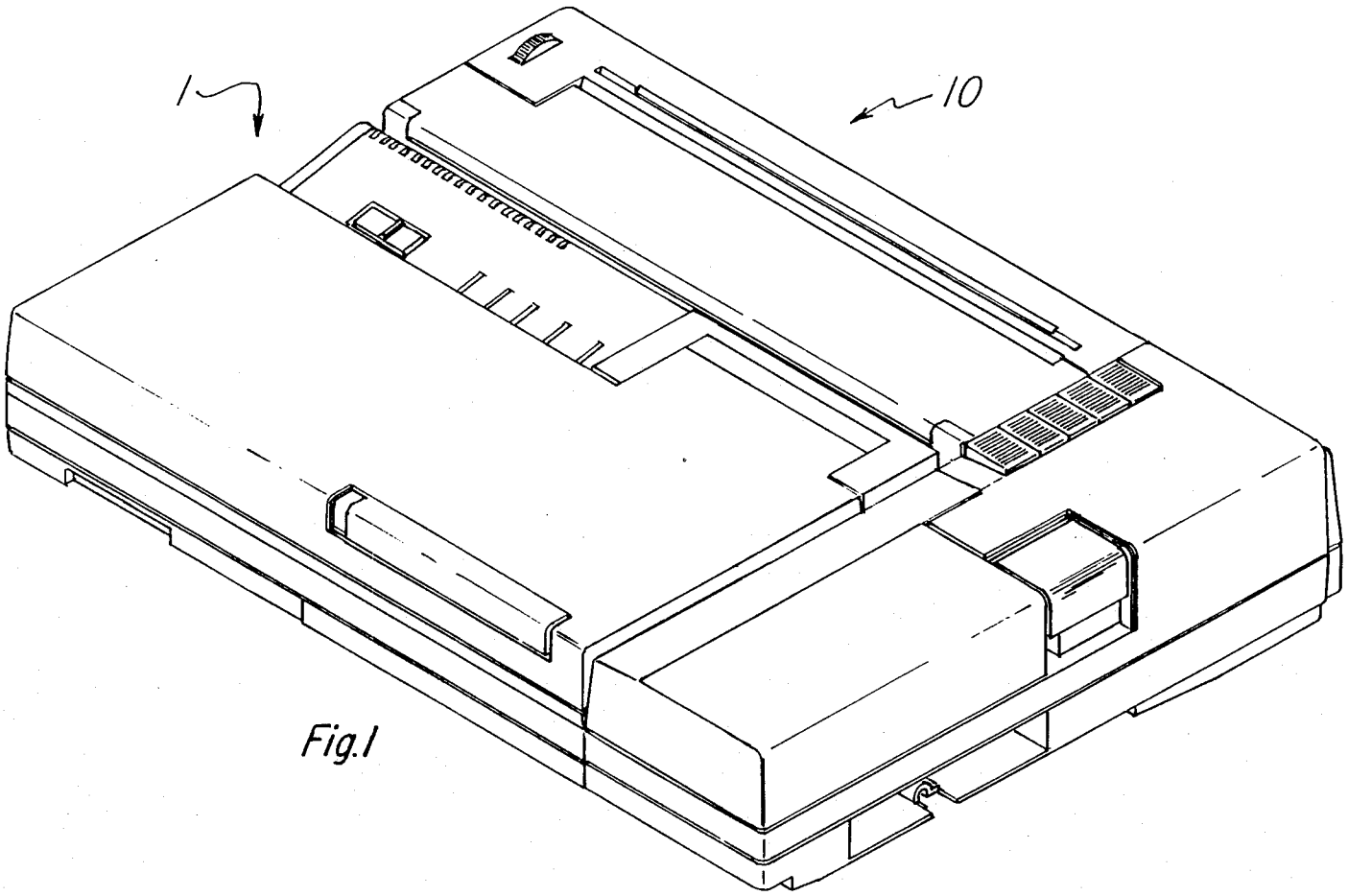
FIG. 1 is a perspective drawing of a portable terminal which incorporates the printer of this invention.

FIG. 1 illustrates portable terminal 1 which incorporates printer 10. In this preferred embodiment, printer 10 is an ink jet printer, but a thermal printer also is alternatively employed. The printer could be a wire matrix printer or any other type printer, with a movable carriage for printing on paper.

Figure 2:
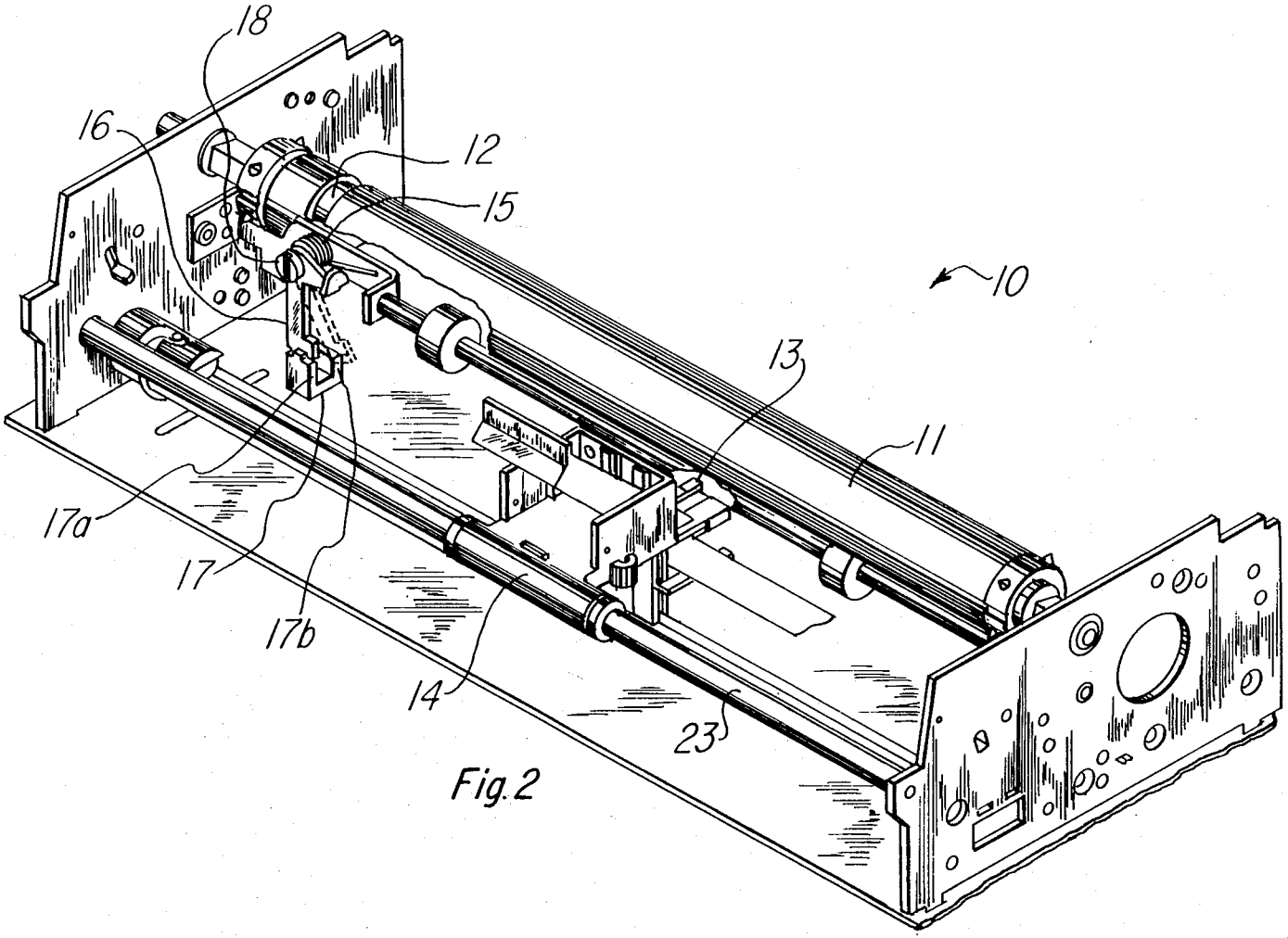
FIG. 2 is a cutaway perspective of the printer of this invention.

FIG. 2 is a cutaway perspective of printer 10 illustrating platen 11 having groove 12 formed therein. Carriage 14 is shown riding on guide rod 23 and having activation arm 13 attached. Carriage 14 carries printhead 22 (see FIG. 5). Activation arm 13 is positioned and intended to strike activation lever arm 16 when carriage 14 moves to the left. Activation lever arm 16 rotates about pivot point 18. Torsion spring 15 bears against the upper end of detection lever arm 16 and the lower end of lever arm 16, as shown in the normal state, blocks light from LED 17a from passing to photo transistor 17*b*, both of optical sensor 17.

Figure 3A:
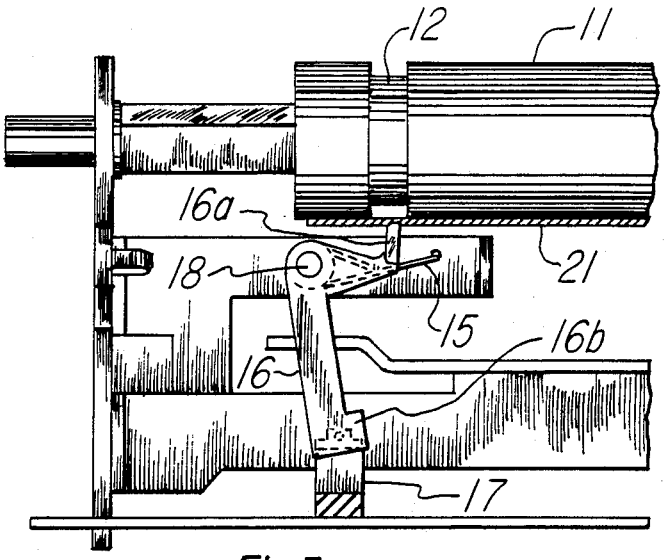
FIGS. 3*a* and 3*b* are cutaway front views illustrating a paper-in and a paper-out condition, respectively.

FIG. 3*a* is a sectional front view illustrating detection lever arm 16 in its normal state with its lower end 16*b* positioned within optical sensor 17 and with its upper end 16*a* urged, by spring 15, against paper 21. Paper 21 is shown riding on platen 11, over groove 12.

Figure 3B:
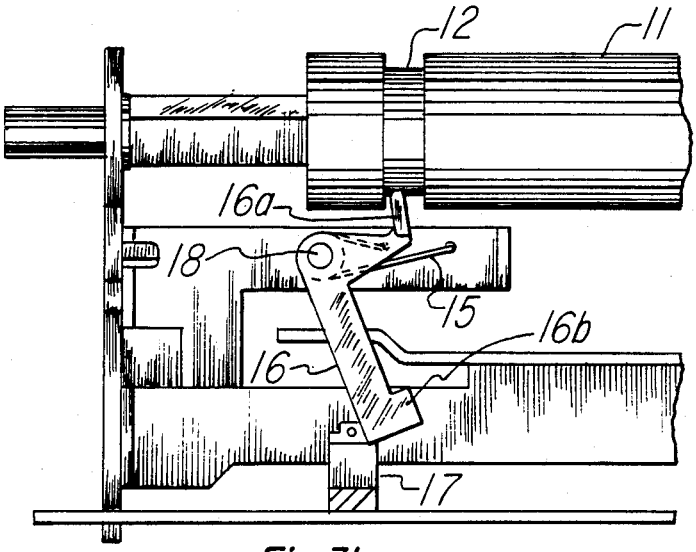

FIG. 3*b* illustrates platen 11 with no paper 21 in place. Under these circumstances, spring 15 has urged the upper end 16*a* of detection lever arm 16 into groove 12, moving lower end 16*b* out of optical sensor 17, thereby enabling a light path between LED 17*a* and photo transistor 17*b*, providing a signal, indicating a paper-out condition.

Figure 4:
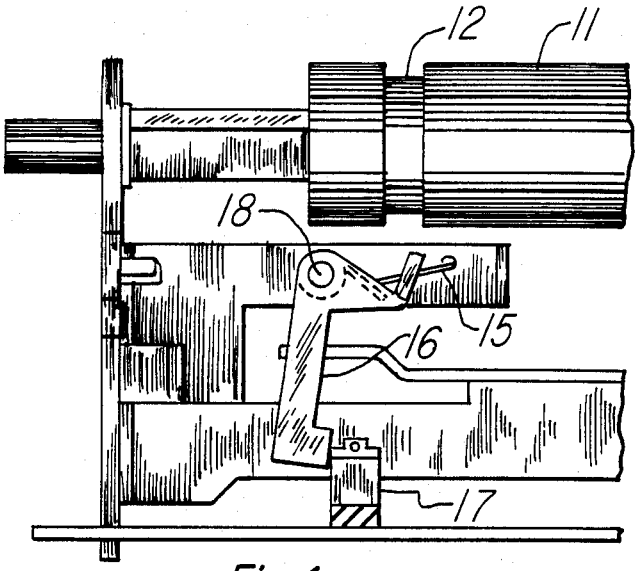
FIG. 4 is a cutaway front view illustrating a column zero position.

FIG. 4 is a cutaway front view illustrating the column zero position. Detection lever arm 16 is shown with lower end 16*b* having been moved away from optical sensor 17, pivoted at point 18. Note that detection lever arm 16 is moved in the opposite direction from the paper-out condition.

Figure 5:
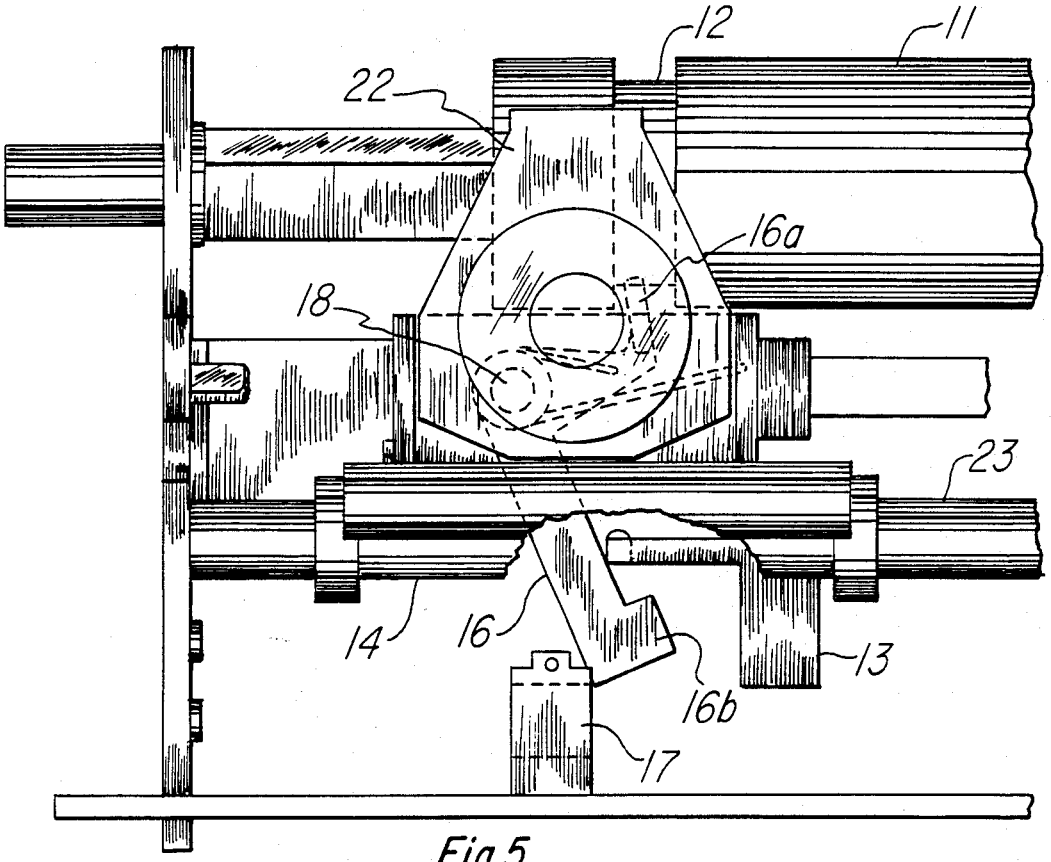
FIG. 5 is a cutaway front view illustrating a paper-out condition about to be changed to a column zero position.

FIG. 5 is a cutaway front section showing detection lever arm 16 in the paper-out position but with activation arm 13 contacting detection lever arm 16 as carriage 14 carrying printhead 22 moves to the left. As the motion of carriage 14 continues, activation arm 13 pushes detection lever arm 16 to the left side of optical sensor 17 as indicated in FIG. 4.

Figure 6:
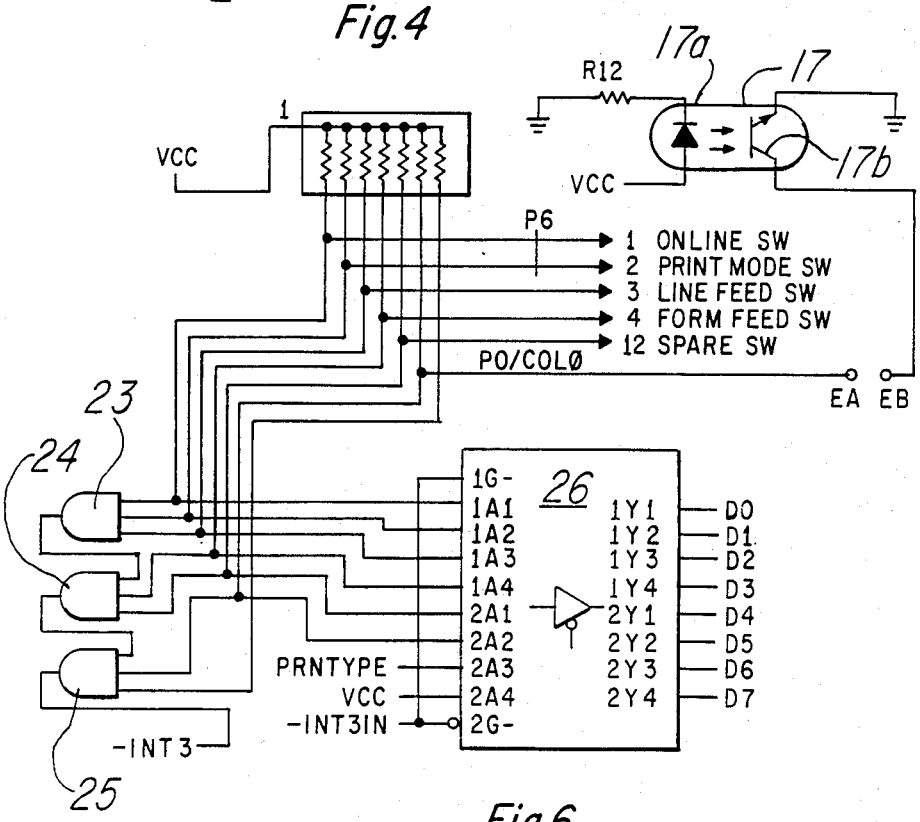
FIG. 6 is a schematic diagram of the generation of the paper-out and column zero signal.

FIG. 6 schematically illustrates LED 17*a* in association with photo transistor 17*b* within optical sensor 17. The collector of photo transistor 17*b* passes signal PO/-COLO through terminals EB and EA, ultimately to AND gate 25, forcing an interrupt signal to be sent to a microprocessor which is part of printer 10. At the same time, the PO/COLO signal is sent through buffer 26 to identify the interrupt.

MODE OF OPERATION

Turn first to FIGS. 3*a* and 3*b*. In FIG. 3*a*, paper 21 is shown covering platen 11 and also covering groove 12, formed in platen 11.

In FIG. 3*b*, it can be seen that paper 21 is no longer present and therefore the upper end 16*a* fits into groove 12, causing lower end 16*b* to move away from optical sensor 17. Then, as can be seen in FIG. 6, signal PO/-COLO is sent from photo transistor 17*b* by way of excitation from LED 17*a*, to AND gate 25. AND gate 25 is ordinarily high, and when signal PO/COLO is received, its output goes low as an interrupt output. The interrupt is received by the microprocessor in the printer which then takes remedial action, based upon the program that responds to the interrupt.

FIG. 4 illustrates detection lever arm 16 in the column zero position having had lower end 16*b* pivoted on pivot 18 to the left of optical sensor 17.

Referring again to FIG. 6, a PO/COLO signal is again sent, generating an interrupt to the microprocessor through AND gate 25.

Column zero is not an ordinary, operational condition. Column zero occurs only upon starting or resetting of the system. Otherwise, during normal operation, column zero cannot occur because the system always return to column one, under control of the microprocessor. Therefore, if signal PO/COLO occurs during normal operation, it must signify a paper-out condition. The operation of the microprocessor is not part of this invention and will not be described herein.

FIG. 5 illustrates a condition where paper-out has been detected as shown by the position of detection lever arm 16. In FIG. 5, activation arm 13 is shown contacting lever arm 16, and as carriage 14 proceeds on guide 23 to the left, lever arm 16 will be moved to the left indicating a column zero position.

It may be that there is a paper-out condition simultaneously present with a column zero position. In that case, a microprocessor moves carriage 14 to the starting position of column one. If signal PO/COLO is still present, then a paper-out condition exists, and remedial action must be taken.

Those skilled in the art may alter specific configurations shown herein without departing from the scope of this invention which is limited only by the appended claims.

What is claimed is:

1. A printer for printing characters on paper having a carriage supporting a printhead that traverses the paper, and having a detection mechanism for detecting the absence of paper and for detecting the end position of the carriage comprising:

(a) detection lever arm means, operationally positioned in a normal state, and selectively movable out of the normal state;

(b) sensing means, for sensing whether the detection lever arm means is positioned in the normal state;

(c) a platen having guide means that is inaccessible when the paper is present, the guide means adapted to cause the detection lever arm means to move out of the normal state in the absence of paper, the sensing means thereby sensing a paper-out condition; and (d) contacting means, associated with the carriage positioned to contact and move the detection lever arm means out of the normal state when the carriage is moved to an end position, the sensing means thereby sensing a column zero position;

(e) said sensing means comprising light emitting means and light detecting means, positioned to receive light emitted by the light emitting means;

(f) said light emitting means comprising a light emitting diode;

(g) said light detecting means comprising a phototransistor;

(h) said guide means comprising a groove formed in the platen and normally covered by the paper, dimensioned to receive the detection lever arm means in the absence of the paper;

(i) wherein the detection lever arm means comprises:

(j) a lever, rotatably mounted, configured to pass between the LED and the phototransistor at the lower end, and to press against the paper at the upper end; and (k) a spring, bearing against the lever to force the upper end of the lever against the paper, causing the lower end to be positioned in the normal state, between the LED and the phototransistor interrupting the light path between the LED and the phototransistor, and in the absence of paper, to force the upper end into the groove and to move the lower end out of the normal state into a state of light communication, indicating a paper-out condition.

2. The printer of claim 1 wherein the contacting means comprises an activation arm, attached to the carriage, positioned to bear against the lever when the carriage moves to the left end position, causing the lower end to move out of the normal state into a state of light communication, indicating a column zero position.

3. A printer for printing characters on paper having a carriage supporting a printhead that traverses the paper, and having a detection mechanism for detecting both the absence of paper and for detecting the end position of the carriage, comprising:

(a) a lever arm rotatable about a pivot and normally disposed in a first predetermined position to detect a first predetermined condition, (b) means on said lever arm responsive to a second predetermined condition to provide rotation of said lever arm in a first direction from said first predetermined position to a second predetermined position, and (c) means responsive to a third predetermined condition to provide rotation of said lever arm responsive to a third predetermined condition in a direction opposite to said first direction from said first predetermined position to a third predetermined position.

4. A printer as set forth in claim 3 wherein said first predetermined condition is the simultaneous presence of paper in said carriage and the absence of a column one position of said carriage.

5. A printer as set forth in claim 3 further including a light emitting means and a light receiving means spaced from each other, said lever arm blocking the transmission of light from said light emitting means to said light receiving means when said lever arm is disposed in said first predetermined position to detect said first predetermined condition.

6. A printer as set forth in claim 4 further including a light emitting means and a light receiving means spaced from each other, said lever arm blocking the transmission of light from said light emitting means to said light receiving means when said lever arm is disposed in said first predetermined position to detect said first predetermined condition.

7. A printer as set forth in claim 3, further including a platen having guide means, said second predetermined condition being the absence of said paper over said guide means, said lever arm responsive to the absence of said paper over said guide means to rotate to said second predetermined position.

8. A printer as set forth in claim 4, further including a platen having guide means, said second predetermined condition being the absence of said paper over said guide means, said lever arm responsive to the absence of said paper over said guide means to rotate to said second predetermined position.

9. A printer as set forth in claim 5, further including a platen having guide means, said second predetermined condition being the absence of said paper over said guide means, said lever arm responsive to the absence of said paper over said guide means to rotate to said second predetermined position.

10. A printer as set forth in claim 6, further including a platen having guide means, said second predetermined condition being the absence of said paper over said guide means, said lever arm responsive to the absence of said paper over said guide means to rotate to said second predetermined position.

11. A printer as set forth in claim 3, wherein said means responsive to a third predetermined condition includes contact means responsive to movement of said carriage to said end position to rotate said lever in said opposite direction to said third predetermined position.

12. A printer as set forth in claim 4, wherein said means responsive to a third predetermined condition includes contact means responsive to movement of said carriage to said end position to rotate said lever in said opposite direction to said third predetermined position.

13. A printer as set forth in claim 5, wherein said means responsive to a third predetermined condition includes contact means responsive to movement of said carriage to said end position to rotate said lever in said opposite direction to said third predetermined position.

14. A printer as set forth in claim 6, wherein said means responsive to a third predetermined condition includes contact means responsive to movement of said carriage to said end position to rotate said lever in said opposite direction to said third predetermined position.

15. A printer as set forth in claim 7, wherein said means responsive to a third predetermined condition includes contact means responsive to movement of said carriage to said end position to rotate said lever in said opposite direction to said third predetermined position.

16. A printer as set forth in claim 8, wherein said means responsive to a third predetermined condition includes contact means responsive to movement of said carriage to said end position to rotate said lever in said opposite direction to said third predetermined position.

17. A printer as set forth in claim 9, wherein said means responsive to a third predetermined condition includes contact means responsive to movement of said carriage to said end position to rotate said lever in said opposite direction to said third predetermined position.

18. A printer as set forth in claim 10, wherein said means responsive to a third predetermined condition includes contact means responsive to movement of said carriage to said end position to rotate said lever in said opposite direction to said third predetermined position.

19. A printer for printing characters on paper having a carriage supporting a printhead that traverses the paper and having a detection mechanism for detecting both the absence of paper contacting the platen and for detecting the end position of the carriage, comprising:

(a) light emitting means, (b) light receiving means disposed to receive light emitted from said light emitting means, and (c) a pivotable lever normally positioned to block the transmission of light between said light emitting means and said light receiving means, said lever pivoting in a first direction responsive to said absence of paper to permit the transmission of light between said light emitting means and said light receiving means, said lever pivoting in a second direction opposite to said first direction responsive to said carriage being in said end position to permit the transmission of light between said light emitting means and said light receiving means.

* * * * *